US005201837A

United States Patent [19]

Lafontaine

[11] Patent Number: 5,201,837

[45] Date of Patent: Apr. 13, 1993

[54] FILM COVERED CHANCE TICKET OR THE LIKE

[76] Inventor: Yves Lafontaine, 546, Saint-Malo East, Ile-Bizard-Montréal, Canada, H9C 2PC

[21] Appl. No.: 846,622

[22] Filed: Mar. 5, 1992

[51] Int. Cl.[5] ..... B42D 15/00

[52] U.S. Cl. ..... 283/108; 283/62; 283/903; 273/139

[58] Field of Search ..... 283/62, 81, 94, 107, 283/109, 108, 110, 901, 903; 273/139, 269, 270, 138 R

[56] References Cited

U.S. PATENT DOCUMENTS 3,822,901 7/1974 Seidman .
4,174,857 11/1979 Koza .
4,705,301 11/1987 Dojel ..... 283/903
4,708,369 11/1987 Greig ..... 283/903
4,993,753 2/1991 Weeks .
5,000,485 3/1991 Matsuguchi et al. .
5,037,101 8/1991 McNutley .
5,118,109 6/1992 Gumina ..... 283/903

FOREIGN PATENT DOCUMENTS 1457998 12/1976 United Kingdom .

*Primary Examiner*—Timothy V. Eley
*Assistant Examiner*—Willmon Fridie, Jr.
*Attorney, Agent, or Firm*—Oblon, Spivak, McClelland, Maier & Neustadt

[57] ABSTRACT

A card including a plate like substrate covered with a film. Printed material appears on the top face of the substrate and other printed material can be seen on the side of the film away from the substrate. The film adhesively and removable covers the substrate in such a way that it can repeatedly be peeled off from the substrate by producing an audible sound which draws attention to a buyer.

16 Claims, 1 Drawing Sheet

FILM COVERED CHANCE TICKET OR THE LIKE

BACKGROUND OF INVENTION (1) Field of the Invention

This invention relates to a card having a film in adhesive contact therewith. More particularly, the present invention pertains to a chance ticket covered with a film to protect the printed material appearing on the top face of the ticket, and which can noisily be removed therefrom to reveal said printed material.

(2) Description of Prior Art

A large variety of chance tickets of all sorts are presently on the market, for example lottery tickets, draw tickets, etc. Obviously, on a marketing point of view, the more the public is attracted to these articles, the easier it is to sell them. One idea is to advertise and display these tickets the best way possible. Also, by relying on color arrangements for presenting the tickets, this may attract the eye and produce more sales. Scratch tickets are other kinds which seem to induce the public to buy them. In other words, anything that excites the curiosity would seem to help in promoting the sale of chance tickets or the like articles.

British Patent No. 1,457,998 discloses tickets for use in lotteries wherein the information on the ticket is concealed with a film of aluminum. By breaking the aluminum film, it is possible to ascertain the information contained on the ticket. However, once the aluminum film is broken, it is not possible to again conceal the information.

U.S. Pat. No. 2,822,901 broadly teaches a removable opaque means verifying a message on an item. The patent does not teach means enabling the opaque means to be replaced over the message.

U.S. Pat. No. 4,174,857 relates to a game ticket of the type including a cover sheet which may only be removed once to ensure that no one else has been informed of the material printed on the ticket.

U.S. Pat. No. 4,993,753 describes a self-assembled personalized hidden message device which includes a base substrate on which a message is written, a transparent cover sheet adhesively covering the message and an opaque coating over the cover sheet, which coating may be rubbed off.

U.S. Pat. No. 5,000,485 describes a multi-layer arrangement wherein a top material and an interlayer peel ply are peelable. There is no teaching that this combination may be replaced over the post card material.

U.S. Pat. No. 5,037,101 describes a hologram game card comprising a plurality of layers including a covering layer which is removable by scratching, rubbing or pulling off. There is no disclosure that the covering layer may be replaced over the combination of layers.

To Applicant's knowledge, there is not presently available on the market, a chance ticket or the like article including a film covering which may be noisily removed by peeling off or replaced at will and of which the main purpose is to draw the attention of a potential buyer.

SUMMARY OF INVENTION

It is an object of the present invention to provide a chance ticket or the like, which is covered with a film, the main purpose of which is to draw the attention of a buyer.

It is another object of the present invention to attract the curiosity of a ticket buyer by covering a ticket with a film which consistently produces a scratching sound when the film is peeled off.

These and other objects of the present invention may be achieved with a card comprising a plate like substrate having first printed material on one face thereof, a film adhesively and removably covering said one face of said plate like substrate having said first printed material thereon, said film having second printed material thereon on one side thereof away from said one face of said plate like substrate, means enabling to repeatedly peel said film off said substrate and thereafter to replace said film over said substrate in adhesive contact therewith, said means also producing an audible attention raising sound when said film is being peeled off said substrate.

The material of the substrate may be chosen depending on specific needs, although it normally consists of paper or plastic.

The material of the film also varies depending on specific requirements, although it normally consists of a plastic material such as polyester, polyacetate, polyethylene or polystyrene. Thin sheets of white paper may also be used.

The film may have a glossy or mat surface.

In accordance with a preferred embodiment of the invention, the substrate has a top coated acrylic coating on the face thereof in contact with the film, the first printed material is formed on the top coated acrylic coating, and a transparent water base removable adhesive is provided over the top coated acrylic coating while covering the first printed material.

In accordance with another preferred embodiment of the invention, the film has a coating on its side in contact with the substrate which consists of a release coating. This release coating prevents the transfer of the water base removable base adhesive from the substrate to the film and is responsible for producing a scratching sound when the film is peeled off.

In accordance with another embodiment of the invention, there is a metal imitation layer, such as aluminum between the release coating and the film, and the film is preferably 0.001 to 0.003 inch thick.

BRIEF DESCRIPTION OF DRAWINGS

Other characteristics and advantages of the invention will appear from the description which follows of an embodiment which is given without limitation with reference to the annexed drawings in which.

DESCRIPTION OF PREFERRED EMBODIMENT

Figure 1:
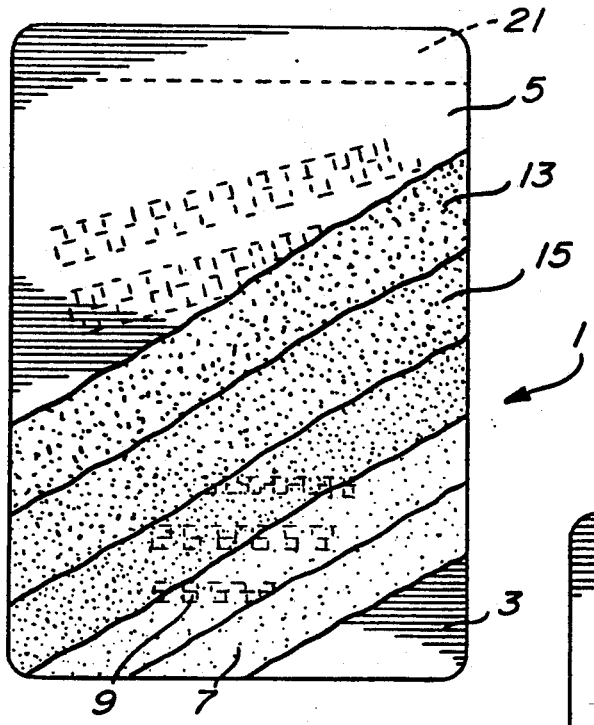
FIG. 1 is a top plan view of a card according to the invention, the, various coating, and film being partly cut away to better illustrate the invention.
Figure 2:
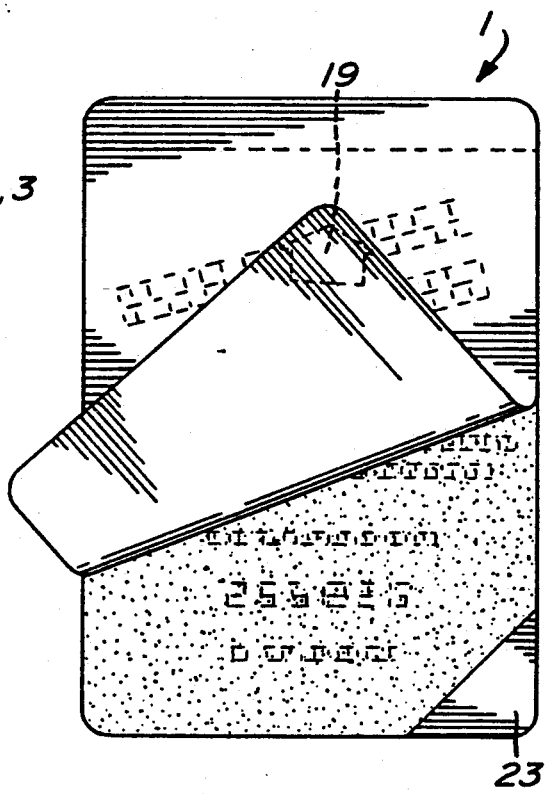
FIG. 2 is a view in perspective of the card while the film is being peeled off.
Figure 3:
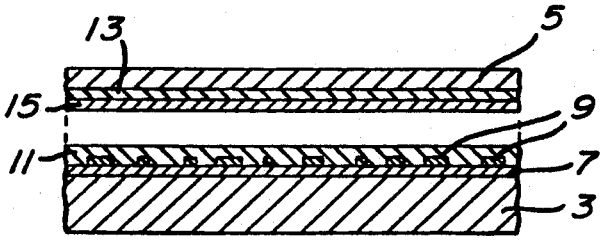
FIG. 3 is a transverse cross-section of the card illustrated.

With reference to the drawings, it will be seen that card 1 according to the invention basically consists of a plate like substrate 3, which in the present case is made of a paper whose thickness is intermediate between cardboard and ordinary sheet paper although it could be made of any suitable material, such as plastic, metal or the like, and a film 5 which is the present case is made of polyester. As mentioned above, the film may be made of any suitable material such as polyacetate, polyethylene, polystyrene, paper or the like. The thickness of the film used in the illustrated embodiment is about 0.001 to 0.003 inch.

The substrate 3 has a thin coating 7 consisting of a top coated acrylic coating, the purpose of which is to first protect the top surface of the substrate and to enable the substrate to receive a printed material 9. Such printed material may be flexographic, letterpress, rotograving, offset and the like processes. For example, this printed material may consist of a lottery number and any information pertinent to the draw and the like. In addition, the substrate contains a thin coat of a transparent water base removable adhesive 11 which is spread over the entire surface of the coating 7 and covers the printed material 9. The thickness of the adhesive coat is not critical and any one skilled in the art would be in a position to determine the exact thickness required which could vary to some extent, depending on the adhesiveness of the film to the substrate that is required and a plurality of other factors which depend on the specific use to which the card is destined. Also the nature of the adhesive may vary to a large extent and the particular choice is entirely left to the designer of a specific card according to the invention.

Turning now to the film 5, it is first provided with a layer of imitation aluminum 13 although any other type of decorative layer may be used. In certain cases, one may entirely dispense with such a layer. Over layer 13 there is provided a release coating 15. This type of coating is well known to those skilled in the art and the choice of a particular brand is entirely left to the decision of the producer of the card. In any case, the only purpose of coating 15 is to prevent the transfer of the transparent water base removable adhesive 11 from the substrate 3 to the film 5. Also, release coating 15 must produce an audible attention raising sound, in the present case a scratching sound. This is all part of the process of drawing the curiosity of a potential buyer, and to protect the inside information.

Finally, on the side of the film 5 which is visible to a buyer, i.e. away from the substrate, there is a printed material 17 which could for example invite a potential buyer to be drawn to buy a card for looking at what is underneath. To enable an easy peeling of the film 5, a sign 19 in the form of an arrow is provided on top of the film in a corner thereof and a triangular portion of the substrate opposite sign 19 is devoid of adhesive.

According to an alternative, the substrate 3 may contain a permanent adhesive in an end portion 21 thereof to prevent a complete peeling off of the film 5. The whole card including the film and substrate may have glossy or mat surfaces.

It will be noted that in addition to providing an excellent marketing idea, the card according to the invention constitutes a good protection for the information that it contains. It could also be used to protect scratch tickets, to store and seal perfume odors, etc.

The production of a card according to the invention presents no particular technical problems and is left entirely to one skilled in the art.

I claim:

1. A card comprising:

a plate like substrate having first printed material on one face thereof, a film adhesively and removably covering said one face of said plate like substrate having said first printed material thereon, said film having second printed material on one side thereof away from said one face of said plate like substrate, means enabling to repeatedly peel said film off said substrate and thereafter to replace said film over said substrate in adhesive contact therewith, said means also producing an audible attention raising sound when said film is being peeled off from said substrate.

2. A card according to claim 1, wherein said substrate is made of paper.

3. A card according to claim 1, wherein said substrate is made of plastic material.

4. A card according to claim 1, wherein said film is made of plastic material.

5. A card according to claim 4, wherein said film is made of a material selected from the group consisting of polyester, polyacetate, polyethylene, polystyrene, paper.

6. A card according to claim 5, wherein said film has glossy surfaces.

7. A card according to claim 5, wherein said film has mat surfaces.

8. A card according to claim 1, which comprises a top coated acrylic coating on said one face of said substrate, said first printed material being formed on said top coated acrylic coating, and a transparent water base removable adhesive over said top coated acrylic coating and covering said first printed material.

9. A card according to claim 8, wherein said film has a coating on the side thereof in contact with said one face of the substrate, which contains a coating material preventing transfer of said water base removable adhesive from said substrate to said film, and responsible for producing a scratching sound when the film is peeled off.

10. A card according to claim 9, wherein said coating material consists of a release coating.

11. A card according to claim 10, wherein said film is provided with a metal imitation layer between said release coating and said film.

12. A card according to claim 11, wherein said metal imitation layer is an aluminum imitation layer.

13. A card according to claim 12, wherein said film has a thickness between about 0.001 and 0.003 inch.

14. A card according to claim 1, wherein said substrate has a corner portion devoid of adhesive and said film has a printed indication opposite said corner portion suggesting where said film may be held for peeling off.

15. A card according to claim 1, wherein said substrate has an end portion provided with a permanent adhesive to prevent a complete peeling off of said film.

16. A chance ticket card comprising a plate like substrate made of paper, said substrate having a top coated acrylic coating on one face thereof, a first printed material being formed on said top coated acrylic coating, and a transparent water base removable adhesive over said top coated acrylic coating and covering said first printed material, said ticket also comprising a polyester film having a thickness of about 0.001 to 0.003 inch, said film having a glossy surface and comprising a second printed material on one side thereof away from said one face of said substrate when said film is in contact with said substrate, said film having a release coating on the side thereof in contact with said substrate, said release coating to prevent transfer of said water base removable adhesive from said substrate to said film, and responsible for producing a scratching sound when peeling said film off said substrate, said film having an aluminum imitation layer between said release coating and said film.

* * * * *